US010968574B2

(12) United States Patent
Mikowychok

(10) Patent No.: US 10,968,574 B2
(45) Date of Patent: Apr. 6, 2021

(54) AUTOMATIC VIBRATOR ASSEMBLY USABLE WITH A CONCRETE FINISHING TOOL

(71) Applicant: Frank Mikowychok, Lincoln, CA (US)

(72) Inventor: Frank Mikowychok, Lincoln, CA (US)

( * ) Notice: Subject to any disclaimer, the term of this patent is extended or adjusted under 35 U.S.C. 154(b) by 65 days.

(21) Appl. No.: 16/559,426

(22) Filed: Sep. 3, 2019

(65) Prior Publication Data

US 2021/0062437 A1 Mar. 4, 2021

(51) Int. Cl.

| | |
|---|---|
| ***E01C 19/00*** | (2006.01) |
| ***E01C 19/38*** | (2006.01) |
| ***E01C 19/40*** | (2006.01) |
| *E04F 21/24* | (2006.01) |

(52) U.S. Cl.

CPC ..... *E01C 19/38* (2013.01); *E01C 19/402* (2013.01); *E04F 21/242* (2013.01)

(58) Field of Classification Search

CPC ..... E01C 19/38; E01C 19/402; E04F 21/242
USPC ..... 404/73, 75, 82–94, 104, 114
See application file for complete search history.

(56) References Cited

U.S. PATENT DOCUMENTS

| | | | | |
|---|---|---|---|---|
| 2,740,336 | A | 4/1956 | Degen | |
| 2,989,869 | A | 6/1961 | Hanggi | |
| 3,188,054 | A | 6/1965 | Mason | |
| 3,237,896 | A | 3/1966 | Peterson | |
| 4,431,336 | A | 2/1984 | Nightengale | |
| 5,234,283 | A | 8/1993 | Adkins | |
| 5,235,314 | A * | 8/1993 | Whetzal, Jr. | G08B 7/06 15/235.3 |
| 5,632,569 | A | 5/1997 | Szmansky | |
| 5,796,188 | A | 8/1998 | Bays | |
| 6,139,217 | A | 10/2000 | Reuter | |
| 6,231,331 | B1 | 5/2001 | Lievers | |
| 6,374,569 | B1 | 4/2002 | Suckow | |
| 6,402,425 | B1 * | 6/2002 | Paladeni | E01C 19/29 404/103 |
| 6,474,906 | B1 * | 11/2002 | Cunningham | E01C 19/29 404/103 |
| 6,780,369 | B1 * | 8/2004 | Darrow | B28B 1/093 264/162 |
| 6,923,595 | B1 * | 8/2005 | Chek | E01C 19/402 15/235.4 |
| 6,976,909 | B1 | 12/2005 | Hoover | |
| 6,988,851 | B2 | 1/2006 | Sina | |
| 7,097,384 | B2 | 8/2006 | Lindley | |
| 7,465,121 | B1 | 12/2008 | Hendricks et al. | |

(Continued)

*Primary Examiner* — Raymond W Addie
(74) *Attorney, Agent, or Firm* — Whitley Legal Group, P.C.; AnnMarie Whitley

(57) ABSTRACT

An automatic vibrator assembly includes a single vibrator mechanism or first and second vibrator mechanisms connected to first and second switch assemblies that are all housed with a case that attaches between a concrete finishing tool float and adaptor using industry standard bolt layouts. The vibrator mechanisms propel the float when the switch assemblies recognize a predetermined amount of forward and backward float tilt. Where the assembly uses two vibrator mechanisms or a single bidirectional vibrator assembly, the vibrator mechanisms can propel the float in different directions depending on the direction of tilt. Additional features include a variable speed controller, master switch for operating in automatic or manual mode, and docks that accommodate one or two removable batteries.

20 Claims, 9 Drawing Sheets

(56) References Cited

U.S. PATENT DOCUMENTS

| | | | | |
|---|---|---|---|---|
| 8,221,027 | B2 * | 7/2012 | Lura | E01C 19/24 404/103 |
| 8,230,760 | B1 | 7/2012 | Breeding | |
| 8,262,440 | B2 | 9/2012 | Krompack | |
| 9,139,966 | B1 | 9/2015 | Mikowychok | |
| 9,397,531 | B2 | 7/2016 | Mikowychok | |
| 9,719,215 | B2 | 8/2017 | Mikowychok | |
| 10,184,217 | B2 | 1/2019 | Mikowychok | |
| 10,326,331 | B2 | 6/2019 | Mikowychok | |
| 2005/0036837 | A1 | 2/2005 | Marshall | |
| 2005/0163566 | A1 * | 7/2005 | Lindely | E04G 21/066 404/114 |
| 2007/0201302 | A1 * | 8/2007 | Lindley | E04G 21/08 366/123 |
| 2008/0050177 | A1 | 2/2008 | Sager | |
| 2012/0183351 | A1 | 7/2012 | Brening | |
| 2013/0223929 | A1 | 8/2013 | Stephens | |
| 2015/0022040 | A1 | 1/2015 | Mikowychok | |

* cited by examiner

AUTOMATIC VIBRATOR ASSEMBLY USABLE WITH A CONCRETE FINISHING TOOL

FIELD OF THE INVENTION

The present invention relates to novel and useful automatic vibration departing devices for concrete finishing tools.

BACKGROUND OF THE INVENTION

Concrete finishing tools, such as floats, jointers, screeds and the like, are used to provide a particular finished surface adjusted to a freshly poured concrete mass. In the conventional method of use of such concrete finishing tools, an operator moves the tool across the surface of the freshly poured concrete, usually in a back and forth manner, before the concrete mass cures or dries.

It has also been recognized that the addition of a vibratory action to the concrete finishing tool aids in the creation of a surface, characteristic, such as a smooth surface and in the case of a jointer, possesses a groove to control cracking of the finish concrete slab. Vibration devices for concrete finishing tools are useful for this purpose and include those where an external motor is mounted to a handle or shaft and linked to a remote vibration mechanism by the use of a cable or gear mechanism and where a power source is placed within the handle of the concrete finishing tool and provides power to vibrators that are located atop of the head of the finishing tool adjacent the concrete. Additionally, some concrete finishing tools include a vibrator that is placed within the handle structure of the tools and powered by a battery that is also found in the handle. These vibration devices and tools do not account for controlling the vibration within the handle, other than by control of electrical power to the vibrator mechanism. These tools also do not provide assistance to the operator for propelling the concrete finishing tool in multiple directions and do not provide an automatic adjustment for optimizing assistance when the operator changes the direction of the tool's path.

A vibration imparting device for a concrete finishing tool that is self-contained and between the handle and terminus of the concrete finishing tool and allows for optimum vibration of the vibrator mechanism and that automatically assists the operator in propelling the concrete finishing tool forward and backward would be a notable advance in the construction arts.

SUMMARY OF THE INVENTION

In accordance with the present invention several embodiments of a novel and useful automatic vibration imparting assembly for a concrete finishing tool are herein provided.

The present invention incorporates a one or more vibrator mechanisms housed within a case that attaches to a standard float using industry standard float adapter bolt layouts. The vibrator mechanisms can be, for example, a single bidirectional vibrator mechanism or multiple opposing unidirectional vibrator mechanisms. Alternatively, the vibrator mechanisms can be a single unidirectional vibrator mechanism or multiple complimentary bidirectional vibrator mechanisms. The case houses or supports at least one motor housing, at least one rechargeable battery or female socket to receive a rechargeable battery, one or more automatic switch assembly, a voltage relay, and optionally a variable speed motor controller and a variable speed input. The automatic switch assembly includes a tilt sensor that can be any sensor that detects a threshold level of inclination or tilt such as a level sensing gyroscope, a micro-electro-mechanical system (MEMS), inclinometer, or other types and configurations or level sensors. Preferably, there are two tilt sensors each of which is a micro switch lever sensor configured to cooperate with an arrangement of reciprocating members disposed in an angled tube. The tilt sensors are coupled to the vibrator mechanisms to selectively engage the desired unidirectional vibrator mechanism or to selectively engage the mode of the bidirectional vibrator mechanism, depending on how much and in what direction the case and float are tilted by the operator. The optional variable speed motor controller is also coupled to each motor and receives input from the variable speed input regarding at what speed the motor should operate when the automatic vibrating assembly is placed in manual mode. The batteries are coupled to the motors to provide power necessary to operate the motors. Preferably, the case in this embodiment has a rectangular footprint, defines openings for connectors and inputs, and includes a removable lid. The motor housings are removably secured in the case preferably with a rubber gasket sandwiched between the motor housing and the case or by resting on and attaching to a plurality of pillars within the case to prevent direct contact between the housing and case. Each motor housing contains a vibrator mechanism. Operationally, the opposing unidirectional vibrator mechanisms and corresponding motors can be selectively operated, or the bidirectional vibrator mechanism and corresponding motor can be operated as desired, in either a first or second direction according to the tilt level sensor recognizing how the operator has tilted the attached float so that it is propelled either forward or backward. Where only a single unidirectional vibrator mechanism and corresponding motor is present, the motor operates only when the attached float is tilted a predetermined amount.

The case for the automatic vibrator assembly of the present invention preferably attaches to the float, and the lid of the case preferably attaches to a float knuckle adaptor. The float knuckle adaptor is configured to accept poles or tubes commonly used to push and pull a float when finishing concrete. Additionally, support pillars are positioned in the case to provide additional support between the float side of the case and the float knuckle adaptor side of the case.

For a better understanding of the invention reference is made to the following detailed description of the preferred embodiments of the invention which should be taken in conjunction with the above described drawings.

DETAILED DESCRIPTION OF THE INVENTION

Figure 4:
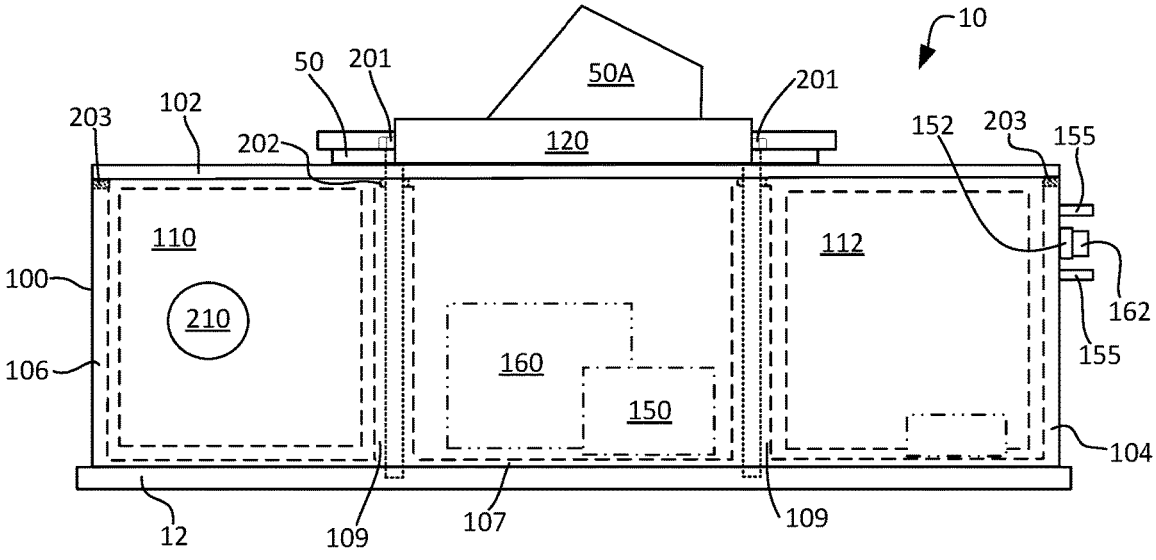
FIG. 4 is a side view of the embodiment shown in FIG. 2.
Figure 5:
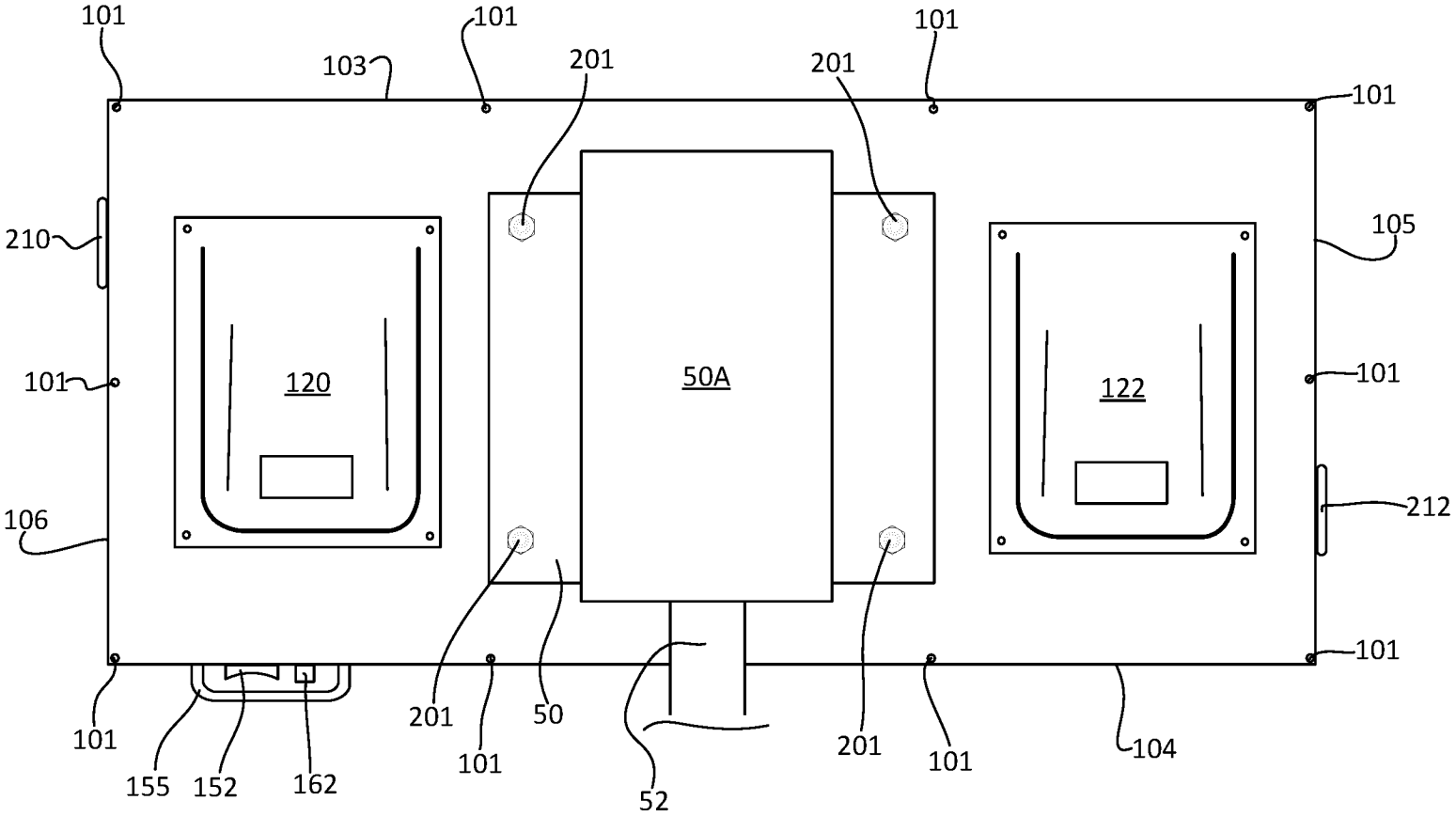
FIG. 5 is a top view of the embodiment shown in FIG. 2.
Figure 6:
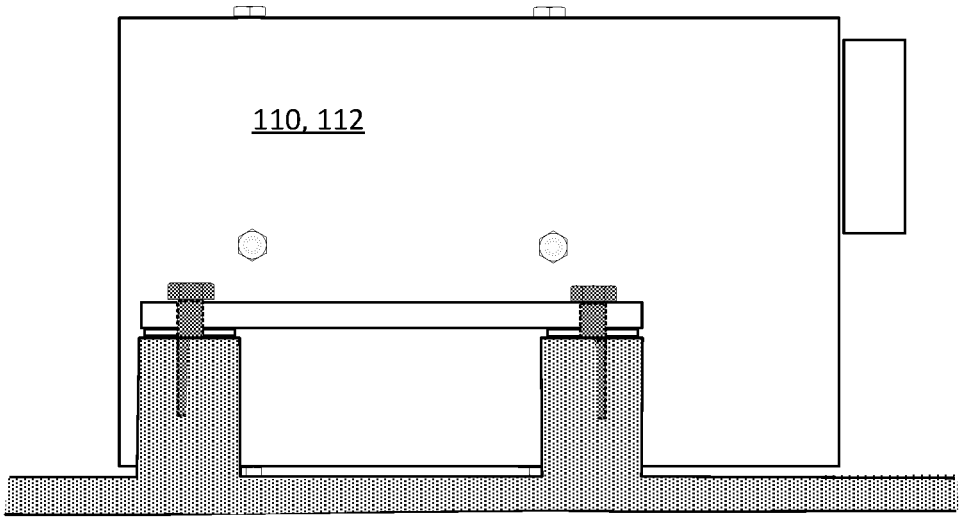
FIG. 6 is a side view of a vibrator mechanism of the present invention.
Figure 7:
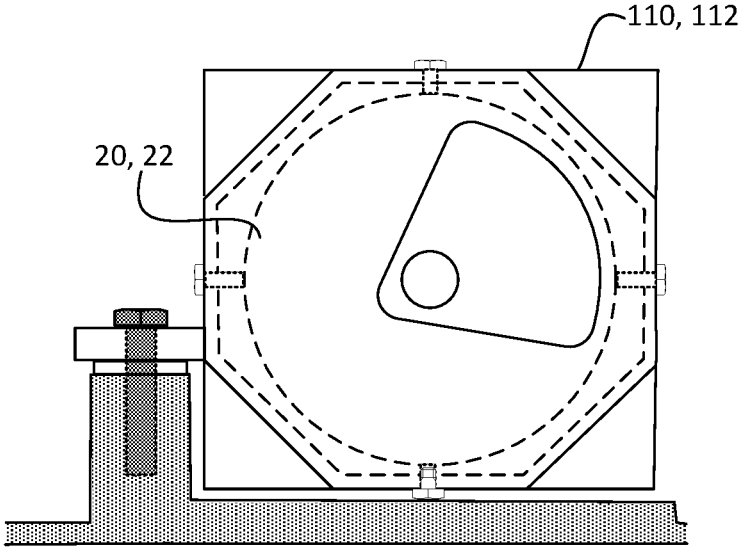
FIG. 7 is an end view of the vibrator mechanism of the present invention.
Figure 11:
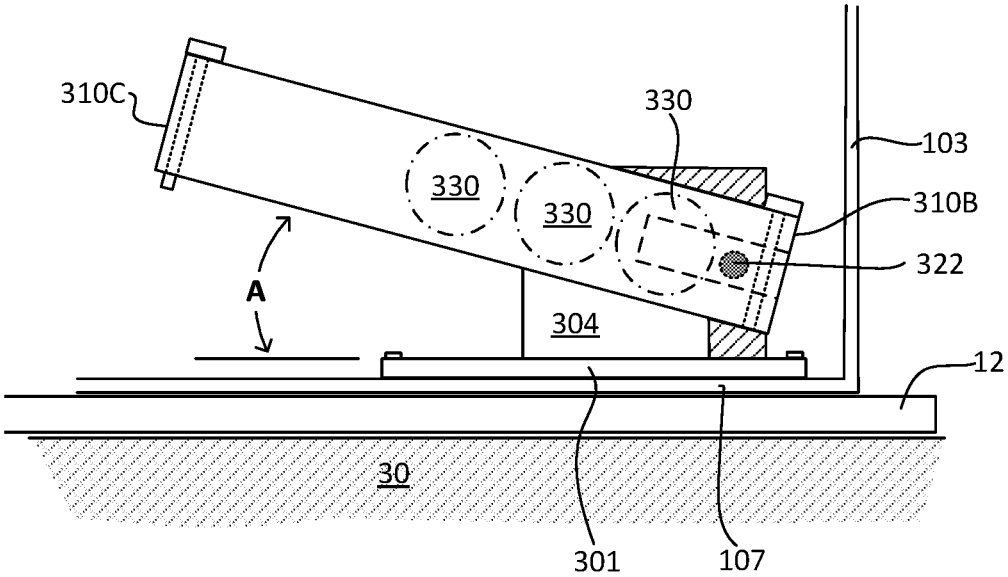
FIG. 11 is an illustration of the level sensor orientation when attached to a level float.
Figure 12:
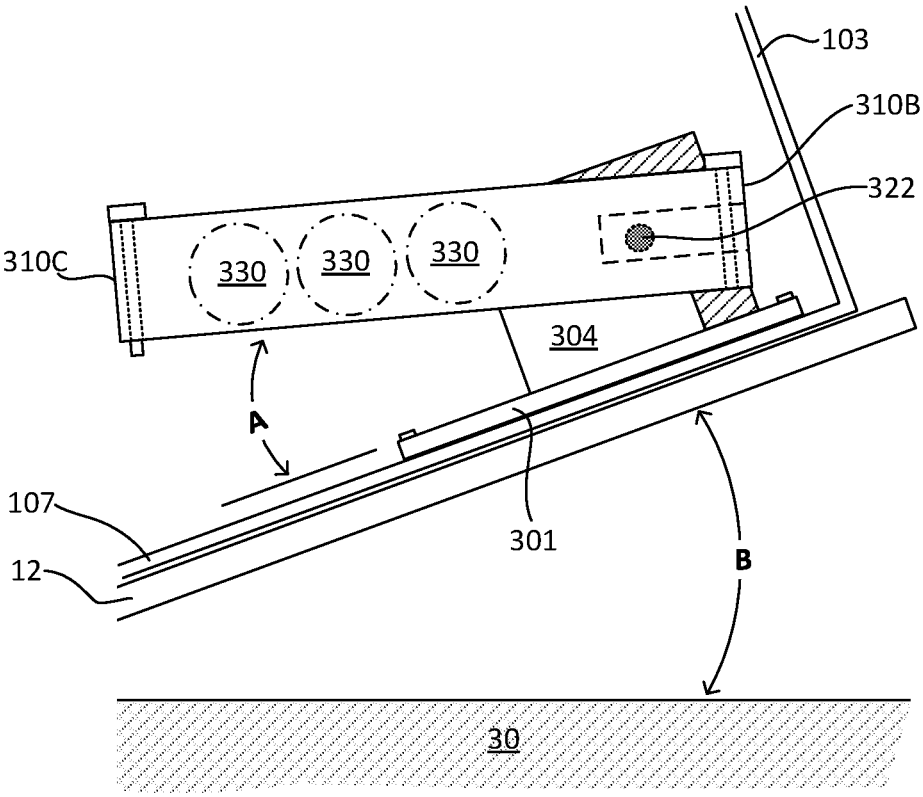
FIG. 12 is an illustration of the level sensor orientation when attached to a tilted float.
Figure 13:
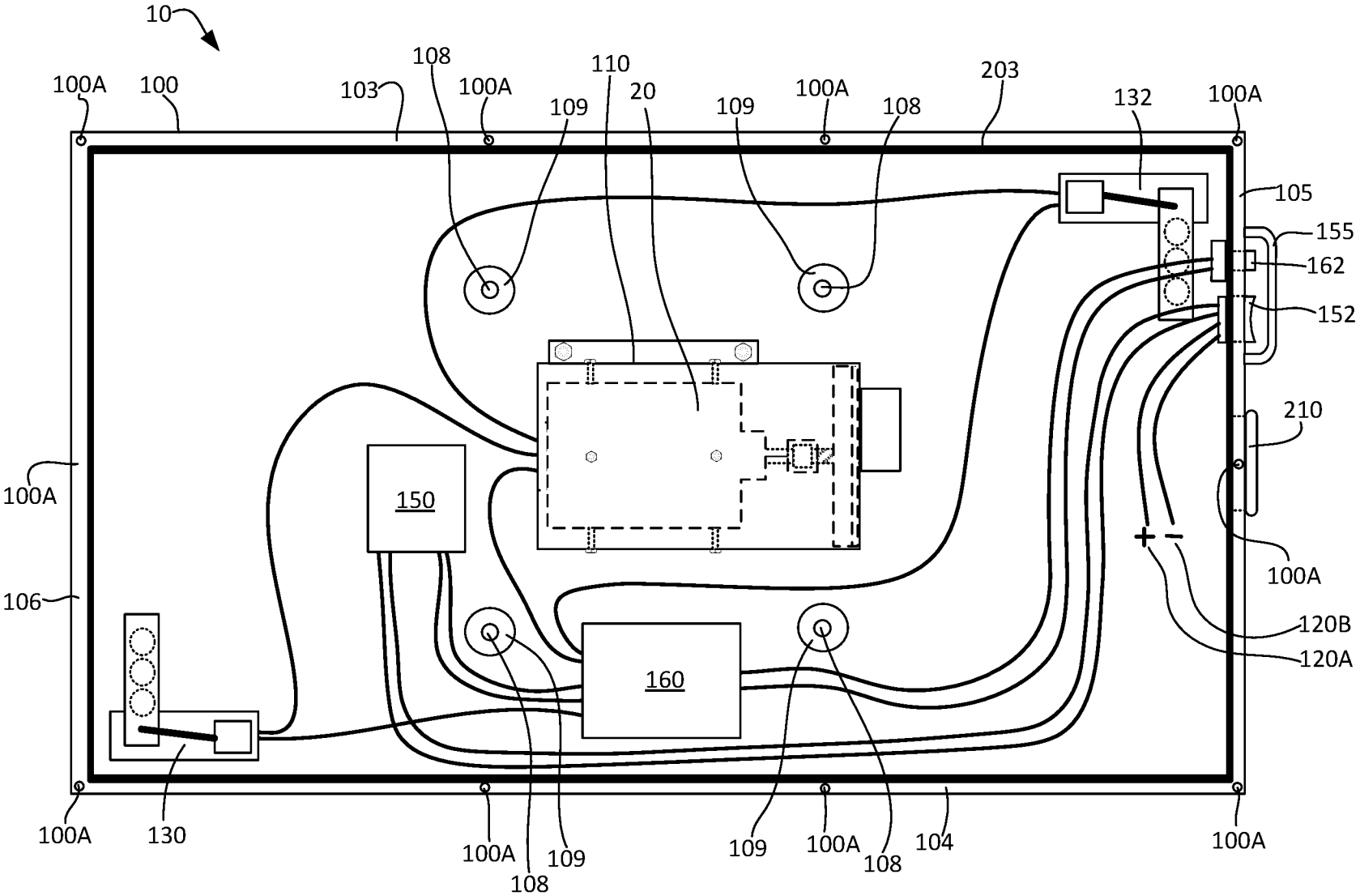
FIG. 13 is an overhead plan view of an alternative embodiment of the present invention.
Figure 14:
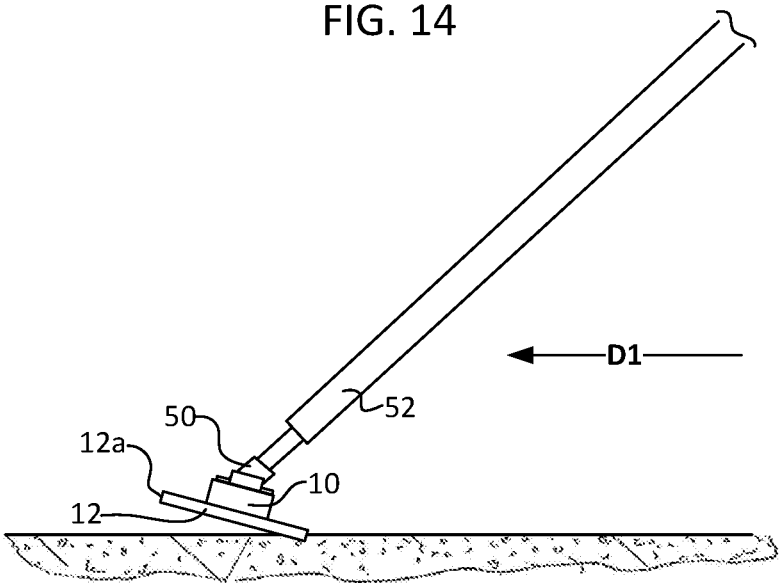
FIG. 14 is a side partial elevational view of a concrete finishing tool with the automatic vibration imparting assembly of the present invention installed therein as it is being pushed in forward direction D1.
Figure 15:
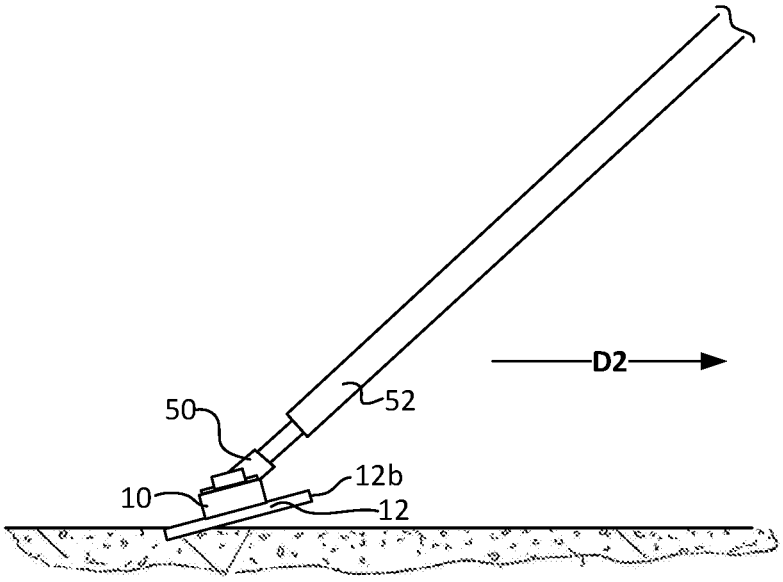
FIG. 15 is a side partial elevational view of a concrete finishing tool with the automatic vibration imparting assembly of the present invention installed therein as it is being pulled in backward direction D2.

Various aspects of the present invention will evolve from the following detailed description of the preferred embodiments thereof which should be referenced to the prior described drawings. FIGS. 1-13 illustrate embodiments of an automatic vibrator assembly 10 for use with concrete finishing tool. Embodiments of the present invention incorporating multiple vibrator mechanisms 20 are shown in FIGS. 1-5. Embodiments of the present invention incorporating a single vibrator mechanism 20 is shown in FIG. 13. FIGS. 6-7 illustrate a vibrator mechanism useful with the present invention, and FIGS. 8-12 illustrate the preferred embodiment of the level sensor of the present invention. FIGS. 14-15 illustrate the automatic vibrator assembly 10 in operation.

FIGS. 1-5 illustrate a preferred embodiment of the present invention where multiple vibrator mechanisms 20, 22 are housed within a case 100. Alternatively, a single vibrator mechanism 20 can be used as illustrated in FIG. 13. Each vibrator mechanism 20, 22 preferably includes a bidirectional or unidirectional motor and rotor assembly such as the ones described in U.S. Pat. Nos. 10,326,331, 9,719,215, 9,397,531, and 9,139,966, which are incorporated herein by reference. Unidirectional motors rotate either clockwise or counter-clockwise, and bidirectional motors can switch between and rotate both clockwise and counter-clockwise. By using either two unidirectional motors that rotate in opposing directions or one bidirectional motor, the vibrator mechanisms facilitate movement of the attached float 12 forward or backward depending on the rotation of the motor. Similarly, using two bidirectional motors can also facilitate movement of the attached float 12 forward or backward depending on which direction is selected for the motors. Case 100 also houses or supports at least one motor housing 110, at least one rechargeable or removable battery 120 or female socket (not shown) to receive a rechargeable battery, an automatic switch assembly 130, a voltage relay 150, and optionally a variable speed motor controller 160 and a variable speed input 162.

Figure 1:
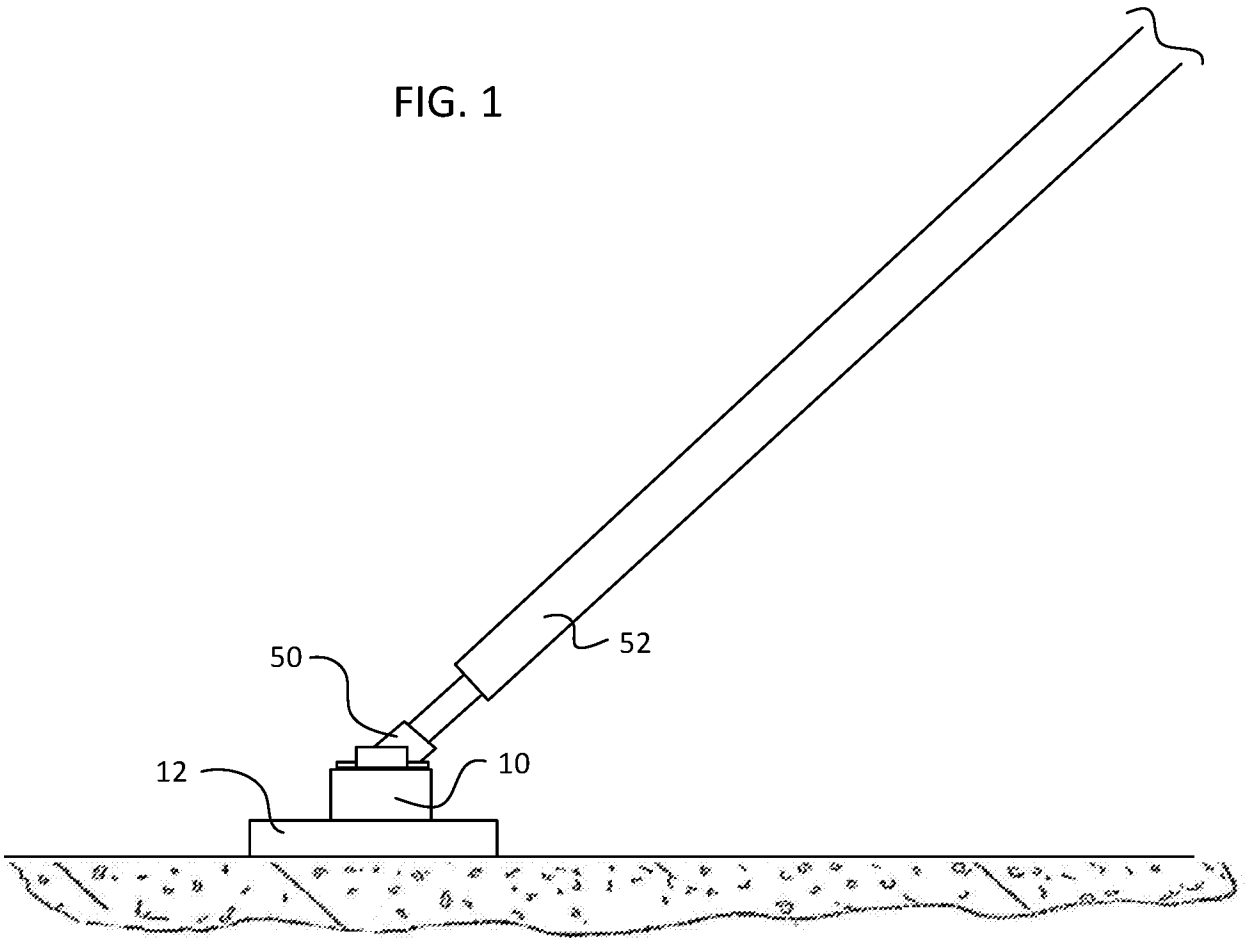
FIG. 1 is a side partial elevational view of a concrete finishing tool with the automatic vibration imparting assembly of the present invention installed therein.
Figure 2:
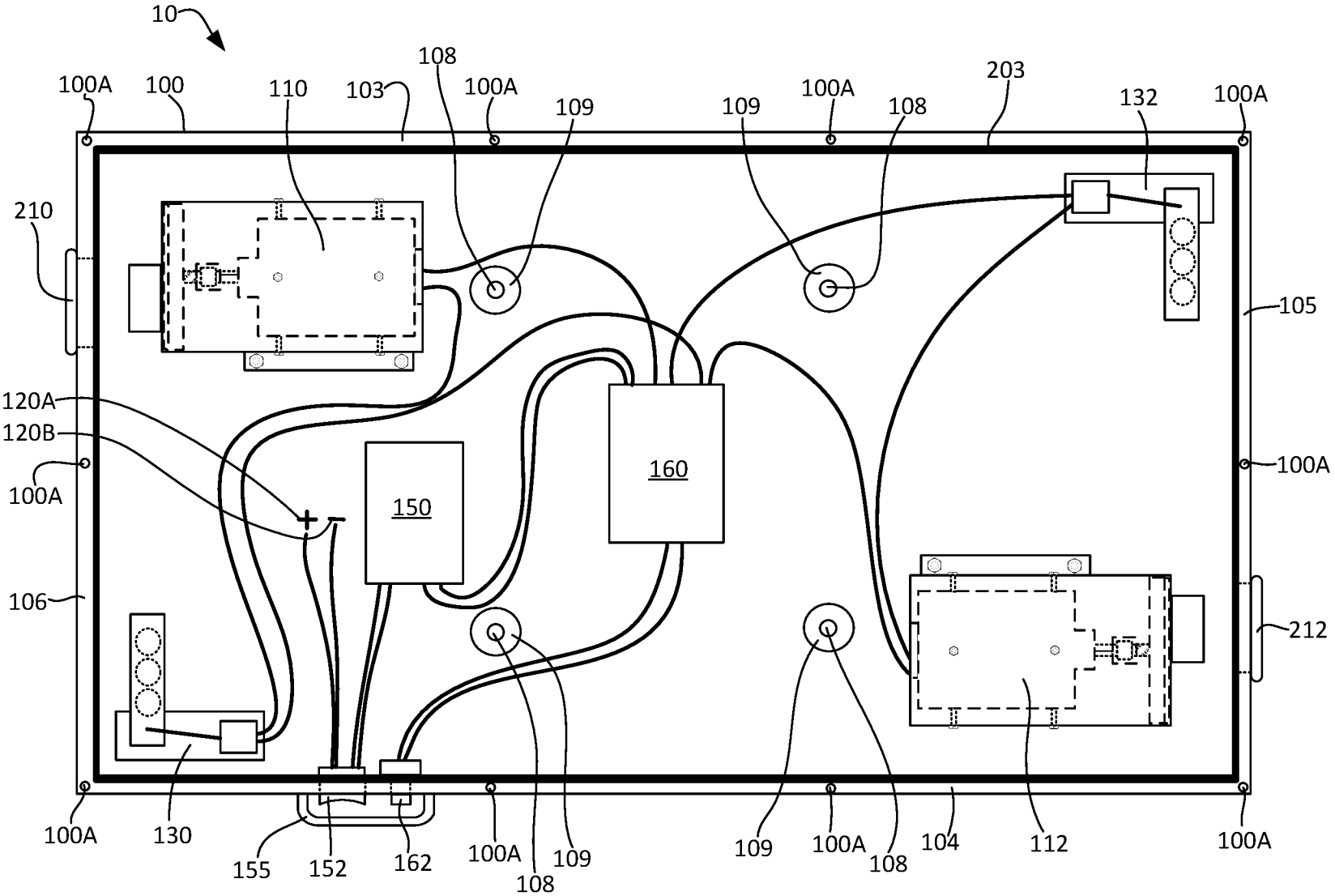
FIG. 2 is an overhead plan view of the preferred embodiment of the present invention.

Preferably, as shown in FIGS. 1-5, case 100 defines a chamber that houses first and second motor housings 110, 112. Each motor housing 110, 112 at least partly houses first and second vibrator assemblies 20, 22 and preferably removably attaches to case 100. For example, motor housings 110, 112 can be removably secured in the case through openings defined by housings 110, 112 with connectors such as bolts. Preferably, motor housings 110, 112 secure with at least two connectors or fasteners, which can be positioned on one side of motor housings 110, at a thickened area of case 100, as shown in FIGS. 2 and 6-7, and motor housings 110, 112 can further optionally be secured with a rubber gasket sandwiched between motor housings 110, 112 and the case 100 to prevent direct contact between housings 110, 112 and case 100. Any method of securing motor housings 110, 112 to case 100, however, can be used as will be understood by those skilled in the art.

Case 100 also preferably houses or supports at least one battery 120 that couples to vibrator mechanisms 20, 22 to provide power necessary to operate their respective motors. Preferably, case 100 houses first and second batteries 120, 122 connected in parallel that couple to vibrator mechanisms 20, 22 to work together to provide power necessary to operate the motors. As shown in FIG. 5, batteries 120, 122 secure to a lid 102 of case 100 and are preferably oriented so that they are substantially equally spaced from the sides 105, 106 of case 100 in order to distribute weight evenly across lid 102. Preferably batteries 120, 122 securely fasten to lid 102 such as directly with bolts or indirectly with docks secured to lid 102 and are in electrical communication with the other components of automatic vibrator 10 as needed. Preferably, batteries 120, 122 are coupled to additional vibrator assembly 10 components with wires or couplers such as positive 120A and negative 120B couplers shown in FIG. 2. Optionally, case 100 defines a female socket for receiving each of batteries 120, 122 so they can be removably secured and electrically connected to the remaining components of automatic vibrator assembly 10. Female socket alternatively could be a simple charging port for a rechargeable battery fixedly secured in or on case 100. Also optionally, batteries 120, 122 can be secured in case 100 rather than on the lid 102 of case 100. Batteries 120, 122 are preferably 18-20 V. Optionally, a voltage regulator also may be coupled to batteries 120, 122 to step down the output to 9 V.

Figure 8:
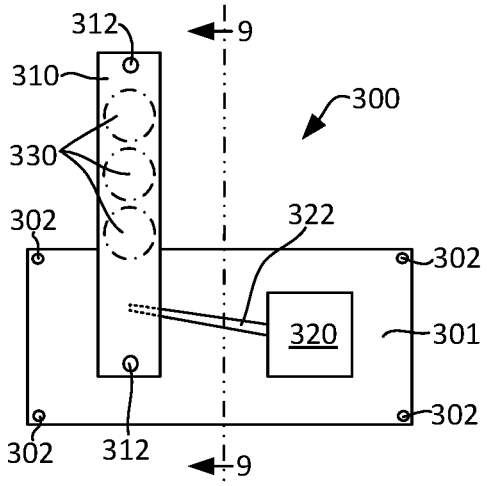
FIG. 8 is a top view of the level sensor of the present invention.
Figure 9:
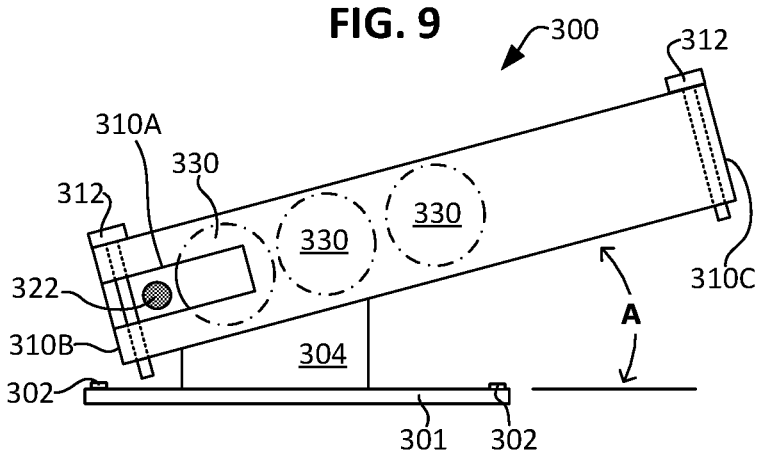
FIG. 9 is a side cutaway view of the level sensor shown in FIG. 8 as cut along the line marked 9-9.
Figure 10:
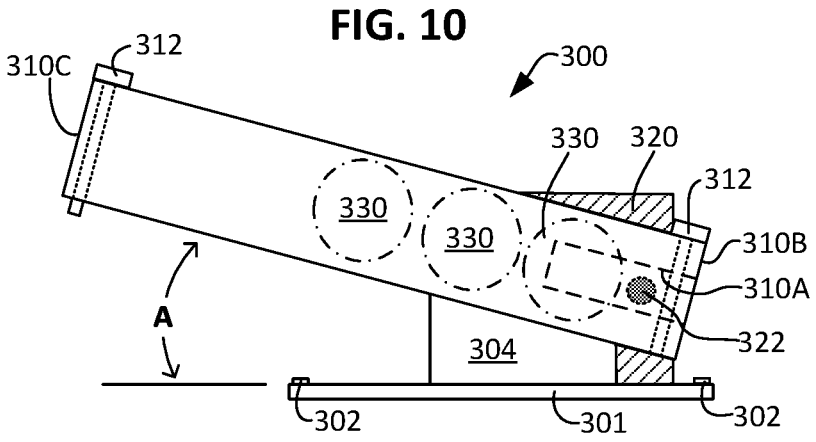
FIG. 10 is an additional side view of the level sensor shown in FIG. 8.

Case 100 further preferably houses automatic switch assembly 130 that couples to first and second vibrator mechanisms 20, 22 using wires or couplers (not labeled). In the preferred embodiment and as shown in FIGS. 2 and 8-10, there are two switch assemblies 130, 132, and each automatic switch assembly 130, 132 includes a tilt sensor 300 optionally mounted on a plate 301. Plate 301 is further configured to mount to case 100 with fasteners 302. Where no plate 301 is present, tilt sensor 300 components may attach directly to case 100 or attach to another component in case 100. Each tilt sensor 300 can be any sensor that detects a threshold level of tilt such as a level sensing gyroscope, a micro-electro-mechanical system (MEMS), inclinometer, proximity sensor, or other types and configurations or level sensors. Preferably, each tilt sensor 300 is a micro switch sensor 320 with a lever 322 such as, for example, a force-actuated micro switch lever and preferably the sensor 320 and lever 322 are configured to cooperate with an arrangement of reciprocating members 330 disposed in an angled tube 310, as shown in FIGS. 8-10. The angled tube 310 preferably has a circular cross-section and is preferably attached near its first end 3108 with a base 304 to plate 301 such that tube 310 inclines at angle A relative to plate 301. Accordingly, first end 3108 is relatively closer to plate 301 than a second end 310C of tube 310, as shown in FIGS. 9-10. Angle A is preferably 8 degrees but other degrees of tilt may be used depending on how the operator uses the finishing tool and float.

Disposed within a channel formed by tube 310 are a series of reciprocating members 330. Preferably, there are three reciprocating members 330 in each tube 310, and reciprocating members 330 are ⅝ inch ball bearings. The ball bearings are secured with tube 310 by bolts 312 that extend across tube 310 at each end as shown in FIG. 9-10. At first end 3108 of tube 310, there is a slot 310A oriented toward proximity sensor 320 and configured to accept lever 322. Lever 322 preferably extends from proximity sensor 320 and into slot 310A such that it can be displaced by reciprocating members 330 when they are located near slot 310A. Accordingly, proximity sensor 320 and lever 322 cooperate so when lever 322 is displaced, level sensor 300 prevents current from flowing and prevents the attached vibration assembly from operating.

In the preferred embodiment, for automatic switch assembly 130, the first end 3108 of tube 310 is near a back wall 104 of case 100. For automatic switch assembly 132, the first end 310B of tube 310 is near a front wall 103 of case 100. FIGS. 11-12 illustrate automatic switch assembly 132 as it is positioned relative to front wall 103 of case 100. As shown in FIG. 11, when float 12 is resting flat relative to a surface of concrete 30, tube 310 is titled at angle A and reciprocating members 330 are resting on lever 322 so that vibrator mechanism 22 is powered off or disengaged. As shown in FIG. 12, when float 12 is tilted at angle B relative to the surface of concrete 30, tube 310 is substantially parallel to the surface of concrete 30 or tilted in such that first end 3108 is spaced a greater distance from the surface of concrete 30 than second end 310C. When float 12 is tilted at angle B or greater relative to the surface of concrete 30, reciprocating members 330 slide away from lever 322 so it can return to a neutral position, which in turn allows vibrator mechanism 22 to operate or engage. Angle B is the threshold level of tilt needed to release lever 322 and is preferably 8 degrees or greater. Angle B can be any amount of tilt that allows reciprocating members 330 to release lever 322, however. Angles A and B are preferably equal, or Angle B is at least slighter greater than angle A. More preferably, Angles A and B relate to the typical amount of tilt used by operators of the concrete finishing tool when pushing and pulling the float 12 along a surface of concrete. Additionally, while it is preferred that Angles A and B are consistent for first and second switch assemblies 130, 132, it is not required. For some configurations, it may be desirable to have different fixed A angles, which will depend on how operators typically use the concrete finishing tool. For example, the ideal threshold level of tilt needed when pushing float 12 forward may be different than the ideal threshold level of tilt need when pulling float 12 backward. Optionally, tubes 310 can be attached to base 304 so that their tilt can be adjusted relative to plate 301, which will allow tool operators to customize their automatic vibrating assembly 10.

The optional variable speed motor controller 160 is also coupled to each vibrator mechanism 20, 22 and receives input from the variable speed input 162 regarding at what speed the motor should operate. Preferably, variable speed input 162 is a twist knob, and input 162 can be positioned on case 100 or on a wirelessly connected remote if automatic vibrator assembly 10 includes remote operation communication and control components. Any type of input that allows for selection among numerous options can be used for input 162, however. Optional variable speed motor controller 160 can be independently coupled and in electrical communication with vibrator mechanisms 20, 22 using wires or couplers (not labeled). There also can be multiple optional variable speed motor controllers and inputs so that one controls the speed of the first motor and another controls the speed of the second motor. Additionally, the variable speed motor controller 160 can be used when automatic vibrator assembly 10 is operating automatically or when it is placed in manual mode.

Case 100 can be any shape and size as long as it provides adequate support and protection for the components housed within it and supported by it. Preferably, case 100 has a substantially rectangular footprint, is preferably made from aluminum and more preferably from 3⁄16 inch thick aluminum, and includes an optional and preferred removable lid 102 that removably attaches to and rests atop four walls that also connect with a floor 107. The four walls include a front side wall 103, a back side wall 104, a first end wall 105, and a second end wall 106. Lid 102 preferably secures to the top of front side wall 103, back side wall 104, and first and second end walls 105 and 106 with fasteners 101 such as screws or bolts that fit into holes 100A defined by the front, back, and side walls. Alternatively, lid 102 may attach with other types of locking or secure fasteners, and preferably is supported by an O-ring or other seal 203 that extends around the top edges of front side wall 103, first end wall 105, back side wall 104, and second end wall 106.

Figure 3:
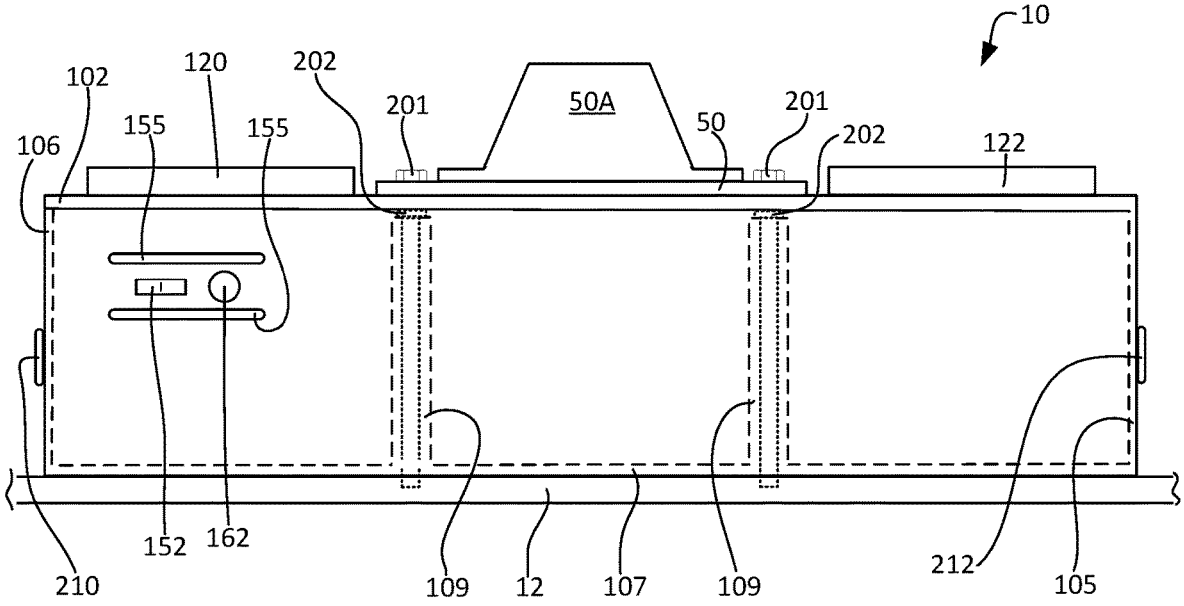
FIG. 3 is a back view of the embodiment shown in FIG. 2.

Case 100 also preferably defines openings for connectors and inputs, and is further sized to cooperate with general float dimensions so that it does not extend beyond the edges of the float. Case 100 also preferably attaches to a standard float 12 using industry standard float adapter bolt layouts. For example, case 100 attaches with bolts to float 12 using case or bolt openings 108 defined by case 100. Preferably, bolt openings 108 are defined by pillars 109 extending upward from and integrally formed with floor 107 as shown in FIGS. 3-4. Optionally, a rubber gasket 202 can also be placed near bolt opening 108 and on pillar 109 to form a seal or cushion between lid 102 and pillars 109.

Case 100 further attaches to a concrete finishing tool pole 52 either directly or by using an adaptor 50 or multiple adaptor components 50 and 50A. For example, a float adaptor or knuckle adaptor 50 can rest on top or be fixedly attached to case 100 as shown in FIGS. 3-5. Float or knuckle adapter 50 allows a pole 52 to attach to the case and float so that the float can be pushed and pulled by an operator. FIG. 1 illustrates how case 100 is preferably positioned between the float 12 and an adaptor 50 or multiple adaptor components 50 and 50A and concrete finishing tool pole 52. As shown in FIG. 5, adaptor 50A includes connection points that correspond to industry standard float adaptor bolt layouts. Accordingly, a single bolt 201 can extend through and thereby connect the adaptor 50A to case 100 to float 12 through pillars 109 at each bolt location according to the industry standard float adapter bolt layout, as shown in FIGS. 3-4.

Lid 102 provides access to the motor housings 110, 112 and other components housed within case 100. On one or both side walls 105 and 106 of case 100 one or more hinged access doors, rubber or pipe plugs, threaded caps, or large set screws 210, 212 are located to provide access to the components within and specifically to provide access to the bearings of vibrator mechanisms 20, 22 for lubrication and maintenance. Preferably, access plugs 210, 212 are removable threaded plugs. Alternatively, any partly or fully removable object can be used as long as it provides a sealable access port for the bearings.

Case 100 additionally supports a master switch 152 and voltage relay 150, which can be used to power on and off or otherwise activate the motors of vibrator mechanism 20, 22. Master switch 152 which is preferably positioned on case 100 in a location readily accessible by the automatic vibrating assembly 10 operator, such as on back side wall as shown in FIG. 2 or first end wall 105 as shown in FIG. 13. Voltage relay 150 is preferably coupled to master switch 152 and to optional variable speed controller 160, and is positioned in case 100. Master switch 152 is preferably a rocker switch that, with voltage relay 150, allows an operator to switch between manual mode, no power, and automatic mode, such as an on-off-on rocker switch. Preferably, master switch 152 has a first position for selecting manual mode where only the motor of first vibrator mechanism 20 operates, a neutral position for turning the assembly 10 off, and a third position for selecting automatic mode where the first and second vibrator mechanisms 20, 22 are automatically selectively engaged in response to the automatic switch assemblies 130, 132. Master switch 152 is coupled with wires or couplers (not labelled) to one or more of batteries 120, 122 and vibrator mechanisms 20, 22, as will be understood by those skilled in the art. Preferably, master switch 152 is positioned on a wall of case 100 near variable speed controller input 162. More preferably, one or more handles 155 can be fixedly attached to case 100 near switch 152 and input 162 to protect them from accidental damage or use, as shown in FIG. 3. References to master switch 152 herein should be understood to also include voltage relay 150 and other switching components needed to enable switching between components and modes as will be understood by those skilled in the art.

FIG. 13 illustrates an embodiment of the present invention where rather than two vibrator mechanisms 20, 22, a single vibrator mechanism 20 is used. With this embodiment, vibrator mechanism 20 can be a bidirectional vibrator mechanism with a corresponding bidirectional motor or a unidirectional vibrator mechanism with a corresponding unidirectional motor. For a bidirectional vibrator mechanism, automatic switching assemblies 130, 132 signal which direction the motor of bidirectional vibrator mechanism 20 should rotate. For a unidirectional vibrator mechanism, automatic switching assemblies 130, 132 signal whether the motor should be engaged. For example, if no tilt is detected, the single unidirectional vibrator mechanism will not engage. Conversely, if either forward or backward tilt is detected, the single unidirectional vibrating assembly will engage. Otherwise, the embodiment shown in FIG. 13 operates in the same way as the preferred embodiment that uses two unidirectional vibrator mechanisms.

Operationally, the automatic vibrating assembly 10 can selectively engage either vibrator mechanism 20, 22 when two vibrator mechanism s are present or the single vibrator mechanism 20 when only one vibrator mechanism is present. Where two opposing unidirectional vibrator mechanism s are present or one bidirectional vibrating assembly is present, vibrating assembly 10 selectively engage the vibrator mechanism or vibrator mechanism's mode so that its motors rotate in a direction that encourages an overall movement of the motor, rotors, and attached float either backward or forward depending on whether the tool operator has oriented float 12 for a backward or forward motion. For example, with respect to the embodiment illustrated in FIGS. 1-12, when the operator wishes to push the float forward, he tilts the float so that the leading edge 12*a* of float 12 and the front wall 103 of case 100 rises. FIG. 14 illustrates how float 12 is tilted during forward motion D1. When float 12 is tilted for forward motion, switch assembly 132 engages vibrator mechanism 22 and switch assembly 130 disengages vibrator mechanism 20. Vibrator mechanism 22 facilitates forward motion, which thereby assists the operator as he pushes float 12 in a forward motion or away from his body. When the tool operator is ready to reverse and pull float 12 backwards, he tilts float 12 in an opposite direction. FIG. 15 illustrates how float 12 is tilted during backwards motion D2. When tilted for backward motion, the trailing edge 12*b* of float 12 and back wall 104 of case 100 rises, switch assembly 132 disengages vibrator mechanism 22, and switch assembly 130 engages vibrator mechanism 20. Vibrator mechanism 20 facilitates backward motion, which thereby assists the operator as he pulls float 12 in a backward motion or back toward his body. Alternatively, when only a single unidirectional vibrator mechanism 20 is present, the automatic vibrator assembly 10 selectively engages vibrator mechanism vibrator mechanism 20 when the trailing edge 12*b* or leading edge of float 12 are tilted for backward or forward motion. When no tilt is selected, the vibrator mechanism 20 is not engaged. While vibrator mechanisms 20, 22 automatically turn on and off depending on the tilt of float 12, at any time the operator can override the automatic operation by using switch 152. Additionally, operator can manually adjust the speed of vibrating assemblies 20, 22 by adjusting the variable speed controller 160 with variable speed input 162. By automatically propelling the float forward or backward, the operator will gain valuable assistance, which will prevent fatigue.

While in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

I claim:

1. An automatic vibrator assembly usable with a concrete finishing tool and a float having industry standard float adaptor bolt layout, the vibrator assembly comprising:

a) a case comprising a lid and defining a case chamber, wherein the case is configured to cooperate with the float's industry standard float adaptor bolt layout and the lid is configured to cooperate with the concrete finishing tool;

b) a vibrator mechanism attached to the case and positioned within the case chamber;

c) a first switch assembly in electrical communication with the vibrator mechanism, wherein the first switch assembly is attached to the case and positioned within the case chamber, comprises a first level sensor, and is configured to selectively engage the vibrator mechanism when a first threshold level of tilt is identified;

d) a second switch assembly in electrical communication with the vibrator mechanism, wherein the second switch assembly is attached to the case and positioned within the case chamber, comprises a second level sensor, and is configured to selective engage the vibrator mechanism when a second threshold level of tilt is identified; and e) a dock for receiving a power source, wherein the dock attaches to the lid and wherein the power source is in electrical communication with the vibrator mechanism when it is positioned in the dock.

2. The automatic vibrator assembly of claim 1 wherein the dock comprises a first dock and a second dock, wherein the first and second docks are configured to receive first and second batteries, and wherein first and second batteries are in parallel electrical communication with the vibrator mechanism.

3. The automatic vibrator assembly of claim 1 wherein the first and second threshold levels of tilt are 8 degrees.

4. The automatic vibrator assembly of claim 1 wherein the first switch assembly comprises:

a) a first tube having a first end and a second end and defining a channel from the first end to the second end and a slot near the first end, wherein the tube is disposed at a first angle relative to the bottom of the case and wherein the first angle corresponds to the first threshold level of tilt;

b) a first plurality of reciprocating members disposed in the first tube;

c) a first micro switch comprising a first lever, wherein the first micro switch is positioned next to the first tube and such that the first lever extends into the channel of the first tube through the slot on the first tube;

d) a second tube having a first end and a second end and defining a channel from the first end to the second end and a slot near the first end, wherein the second tube is disposed at a second angle relative to the bottom of the case and wherein the second angle corresponds to the second threshold level of tilt;

e) a second plurality of reciprocating members disposed in the second tube; and f) a second micro switch comprising a second lever, wherein the second micro switch is positioned next to the second tube and such that the second lever extends into the channel of the second tube through the slot on the second tube.

5. The automatic vibrator assembly of claim 1 wherein the first and second switch assemblies are adjustable such that the first and second threshold levels of tilt are adjustable.

6. The automatic vibrator assembly of claim 1 wherein the vibrator mechanism is a bidirectional vibrator mechanism.

7. The automatic vibrator assembly of claim 1 further comprising:

a) a variable speed controller positioned in the case chamber and in electrical communication with the vibrator mechanism; and b) a variable speed input positioned on the case and in electrical communication with the variable speed controller.

8. The automatic vibrator assembly of claim 1 wherein the vibrator mechanism comprises a first vibrator mechanism and a second vibrator mechanism, wherein the first switch assembly is in electrical communication with the first vibrator mechanism and is configured to selectively engage the first vibrator mechanism when the first threshold level of tilt is identified, and wherein the second switch assembly is in electrical communication with the second vibrator mechanism and is configured to selectively engage the second vibrator mechanism when the second threshold level of tilt is identified.

9. The automatic vibrator assembly of claim 8 wherein the first and second threshold levels of tilt are 8 degrees.

10. The automatic vibrator assembly of claim 8 wherein the first switch assembly comprises:

a) a first tube having a first end and a second end and defining a channel from the first end to the second end and a slot near the first end, wherein the tube is disposed at a first angle relative to the bottom of the case and wherein the first angle corresponds to the first threshold level of tilt;

b) a first plurality of reciprocating members disposed in the first tube;

c) a first micro switch comprising a first lever, wherein the first micro switch is positioned next to the first tube and such that the first lever extends into the channel of the first tube through the slot on the first tube;

d) a second tube having a first end and a second end and defining a channel from the first end to the second end and a slot near the first end, wherein the second tube is disposed at a second angle relative to the bottom of the case and wherein the second angle corresponds to the second threshold level of tilt;

e) a second plurality of reciprocating members disposed in the second tube; and f) a second micro switch comprising a second lever, wherein the second micro switch is positioned next to the second tube and such that the second lever extends into the channel of the second tube through the slot on the second tube.

11. The automatic vibrator assembly of claim 8 further comprising:

a) a variable speed controller positioned in the case chamber and in electrical communication with the first and second vibrator mechanisms; and b) a variable speed input positioned on the case and in electrical communication with the variable speed controller.

12. The automatic vibrator assembly of claim 8 wherein the dock comprises a first dock and a second dock, wherein the first and second docks are configured to receive first and second batteries, and wherein first and second batteries are in parallel electrical communication with the first and second vibrator mechanisms.

13. The automatic vibrator assembly of claim 8 wherein the case comprises:

a) a bottom section comprising a plurality of pillars extending from and integral with the bottom of the case, wherein the pillars are positioned to cooperate with the industry standard float adaptor bolt layout;

b) opposing front and back sides attached to the bottom section wherein the front and back sides are substantially parallel to a leading edge and a trailing edge of the cooperating float when case is attached to the float according to industry standard float adaptor bolt layout;

c) opposing first and second ends attached to the bottom section and positioned between the front and back sides such that the front side, first end, back side, and second end form a perimeter around the bottom section and together with the bottom section form the case chamber; and d) a float adaptor configured to cooperate with a concrete finishing tool, wherein the lid removably attaches to the case sides and ends, and wherein the float adaptor attaches to the float with a plurality of fasteners extending through the lid and case pillars.

14. The automatic vibrator assembly of claim 13 further comprising a master switch positioned on the case and in electrical communication with the first and second vibrator mechanisms and the variable speed controller, wherein the master switch selectively engages first vibrator mechanism only for manual operation, first and second vibrator mechanisms and first and second switching assemblies for automatic operation, or no vibrator mechanisms.

15. The automatic vibrator assembly of claim 13 wherein the first end comprises a first access port positioned to provide access to the first vibrator mechanism and wherein the second end further comprises a first access port positioned to provide access to the second vibrator mechanism.

16. The automatic vibrator assembly of claim 1 wherein the case comprises:

a) a bottom section comprising a plurality of pillars extending from and integral with the bottom of the case, wherein the pillars are positioned to cooperate with the industry standard float adaptor bolt layout;

b) opposing front and back sides attached to the bottom section wherein the front and back sides are substantially parallel to a leading edge and a trailing edge of the cooperating float when case is attached to the float according to industry standard float adaptor bolt layout;

c) opposing first and second ends attached to the bottom section and positioned between the front and back sides such that the front side, first end, back side, and second end form a perimeter around the bottom section and together with the bottom section form the case chamber; and d) a float adaptor configured to cooperate with a concrete finishing tool, wherein the lid removably attaches to the case sides and ends, and wherein the float adaptor attaches to the float with a plurality of fasteners extending through the lid and case pillars.

17. The automatic vibrator assembly of claim 16 further comprising a master switch positioned on the case and in electrical communication with the vibrator mechanism, wherein the master switch selectively engages the vibrator mechanism for manual operation, the vibrator mechanism and first and second switch assemblies for automatic operation, or no vibrator mechanism.

18. The automatic vibrator assembly of claim 16 wherein the first end comprises a first access port positioned to provide access to the vibrator mechanism.

19. An automatic vibrator assembly usable with a concrete finishing tool and a float having industry standard float adaptor bolt layout, a front leading edge, and a trailing leading edge, the vibrator assembly comprising:

a) a case comprising:

i) a bottom section configured to cooperate with the float's industry standard float adapter bolt layout;

ii) opposing front and back sides attached to the bottom section wherein the front and back sides are substantially parallel to the leading edge and a trailing edge of the cooperating float when case is attached to the float according to industry standard float adaptor bolt layout;

iii) opposing first and second ends attached to the bottom section and positioned between the front and back sides such that the front side, first end, back side, and second end form a perimeter around the bottom section and together with the bottom section form a case chamber; and iv) a lid configured to attach to the perimeter of the case and to cooperate with the concrete finishing tool;

b) a first vibrator mechanism attached to the bottom section of the case and positioned within the case chamber;

c) a second vibrator mechanism attached to the bottom section of the case and positioned within the case chamber;

d) a first switch assembly in electrical communication with the vibrator mechanism, wherein the first switch assembly is attached to the bottom section of the case near the back side of the case and positioned within the case chamber, comprises a first level sensor, and is configured to selectively engage the vibrator mechanism when a first threshold level of tilt is identified;

e) a second switch assembly in electrical communication with the vibrator mechanism, wherein the second switch assembly is attached to the case near the front side of the case and positioned within the case chamber, comprises a second level sensor, and is configured to selective engage the vibrator mechanism when a second threshold level of tilt is identified;

f) a variable speed controller positioned in the case chamber and in electrical communication with the vibrator mechanism;

g) a variable speed input positioned on the case and in electrical communication with the variable speed controller;

h) a dock for receiving a power source, wherein the dock attaches to the lid and wherein the power source is in electrical communication with the vibrator mechanism when it is positioned in the dock; and i) a master switch positioned on the case and in electrical communication with the vibrator mechanism, wherein the master switch selectively engages the vibrator mechanism for manual operation, the vibrator mechanism and first and second switch assemblies for automatic operation, or no vibrator mechanism.

20. An automatic vibrator assembly usable with a concrete finishing tool and a float having industry standard float adaptor bolt layout, a front leading edge, and a trailing leading edge, the vibrator assembly comprising:

a) a case comprising:

i) a bottom section configured to cooperate with the float's industry standard float adapter bolt layout;

ii) opposing front and back sides attached to the bottom section wherein the front and back sides are substantially parallel to the leading edge and a trailing edge of the cooperating float when case is attached to the float according to industry standard float adaptor bolt layout;

iii) opposing first and second ends attached to the bottom section and positioned between the front and back sides such that the front side, first end, back side, and second end form a perimeter around the bottom section and together with the bottom section form a case chamber; and iv) a lid configured to attach to the perimeter of the case and to cooperate with the concrete finishing tool;

b) a vibrator mechanism attached to the bottom section of the case and positioned within the case chamber;

c) a first switch assembly in electrical communication with the vibrator mechanism, wherein the first switch assembly is attached to the bottom section of the case near the back side of the case and positioned within the case chamber, comprises a first level sensor, and is configured to selectively engage the first vibrator mechanism when a first threshold level of tilt is identified;

d) a second switch assembly in electrical communication with the vibrator mechanism, wherein the second switch assembly is attached to the case near the front side of the case and positioned within the case chamber, comprises a second level sensor, and is configured to selective engage the second vibrator mechanism when a second threshold level of tilt is identified;

e) a variable speed controller positioned in the case chamber and in electrical communication with the vibrator mechanism;

f) a variable speed input positioned on the case and in electrical communication with the variable speed controller;

g) a dock for receiving a power source, wherein the dock attaches to the lid and wherein the power source is in electrical communication with the vibrator mechanism when it is positioned in the dock; and h) a master switch positioned on the case and in electrical communication with the vibrator mechanism, wherein the master switch selectively engages the vibrator mechanism for manual operation, the vibrator mechanism and first and second switch assemblies for automatic operation, or no vibrator mechanism.

* * * * *